US007047772B2

(12) United States Patent
Yu

(10) Patent No.: US 7,047,772 B2
(45) Date of Patent: May 23, 2006

(54) CABLE LOCK

(76) Inventor: Chun Te Yu, No. 253, Sec. 3, Yanhai Rd., Fusing Township, Changhua County 506 (TW)

( * ) Notice: Subject to any disclaimer, the term of this patent is extended or adjusted under 35 U.S.C. 154(b) by 0 days.

(21) Appl. No.: 10/962,527

(22) Filed: Oct. 13, 2004

(65) Prior Publication Data

US 2006/0075793 A1 Apr. 13, 2006

(51) Int. Cl.
*E05B 37/02* (2006.01)

(52) U.S. Cl. ..... 70/21; 70/30; 70/49; 70/284; 70/285

(58) Field of Classification Search ..... 70/21, 70/284, 285, 46, 41–43, 30, 49, 51–53, DIG. 63, 70/DIG. 71, 27–29, 22, 31, 35–37, 233
See application file for complete search history.

(56) References Cited

U.S. PATENT DOCUMENTS 5,289,704 A * 3/1994 Johnson ..... 70/30
5,868,012 A * 2/1999 Chun-Te et al. ..... 70/30
6,227,016 B1 * 5/2001 Yu ..... 70/30
6,363,758 B1 * 4/2002 Ling ..... 70/30
6,408,660 B1 * 6/2002 Lai ..... 70/30
6,474,116 B1 * 11/2002 Lai ..... 70/25
6,742,366 B1 * 6/2004 Lai ..... 70/58
6,792,778 B1 * 9/2004 Chen ..... 70/21
6,843,080 B1 * 1/2005 Yu ..... 70/21
6,928,842 B1 * 8/2005 Huang ..... 70/21
2005/0155395 A1 * 7/2005 Yu ..... 70/30

* cited by examiner

*Primary Examiner*—Lloyd A. Gall
(74) *Attorney, Agent, or Firm*—Rosenberg, Klein & Lee

(57) ABSTRACT

A cable lock includes a case having a slot defined through a first side and an opening defined through the second side and being in communication with the slot. A flexible cable has one end fixed to the case and a free end of the flexible cable is removably engaged with the opening and the slot. A combination unit is received in the case includes a shaft movably extending through the combination unit. A top plate is connected to a top of the shaft and has a stop plate which is located inside of the second side and movably blocks the opening. A button is pivotably connected to the case and drives an action plate to push the top plate and the shaft downward so as to remove the stop plate away from the opening, and the free end of the flexible cable is able to remove from the opening.

11 Claims, 8 Drawing Sheets

CABLE LOCK

FIELD OF THE INVENTION

The present invention relates to a cable lock that is able to be operated by one hand.

BACKGROUND OF THE INVENTION

A conventional lock with a flexible cable 61 is disclosed in FIG. 11 and generally includes a case 6 with a combination unit is exposed from an outside of the case 6 so as to open an opening 621 such that a free end 611 of the flexible cable 61 can be disengaged from the opening 621. A recess 62 is in communication with the opening 621 and the free end 611 includes a groove so that when the groove is engaged with a periphery of the recess 62, the enlarged end of the free end 611 is restrained in the recess 62. When the user wants to unlock the lock, he has to dial the combination unit by one hand and pulls the cable flexible cable 61 to remove from the opening 621. In other words, it requires two hands to operate the lock and this is inconvenient for the users in some situations.

The present invention intends to provide a cable lock that includes an operation button which is pressed to allow the free end of the flexible cable to disengage from the opening of the cable lock. The cable lock can be locked by only one hand.

SUMMARY OF THE INVENTION

The present invention relates to a cable lock that comprises a case having a slot defined through a first side and an opening defined through a second side and being in communication with the slot. A flexible cable has one end fixed to the case and a free end is removably engaged with the opening and the slot. A combination unit is received in the case and the dial rings are accessible from an outside of the case. The combination unit includes a shaft which movably extends through the combination unit. A top plate is connected to a top of the shaft and has a stop plate which is located inside of the second side and movably blocks the opening.

A button is pivotably connected to the case and has a pushing end which drives an action plate when pressing the button and the action plate pushes the top plate and the shaft downward so as to remove the stop plate away from the opening.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
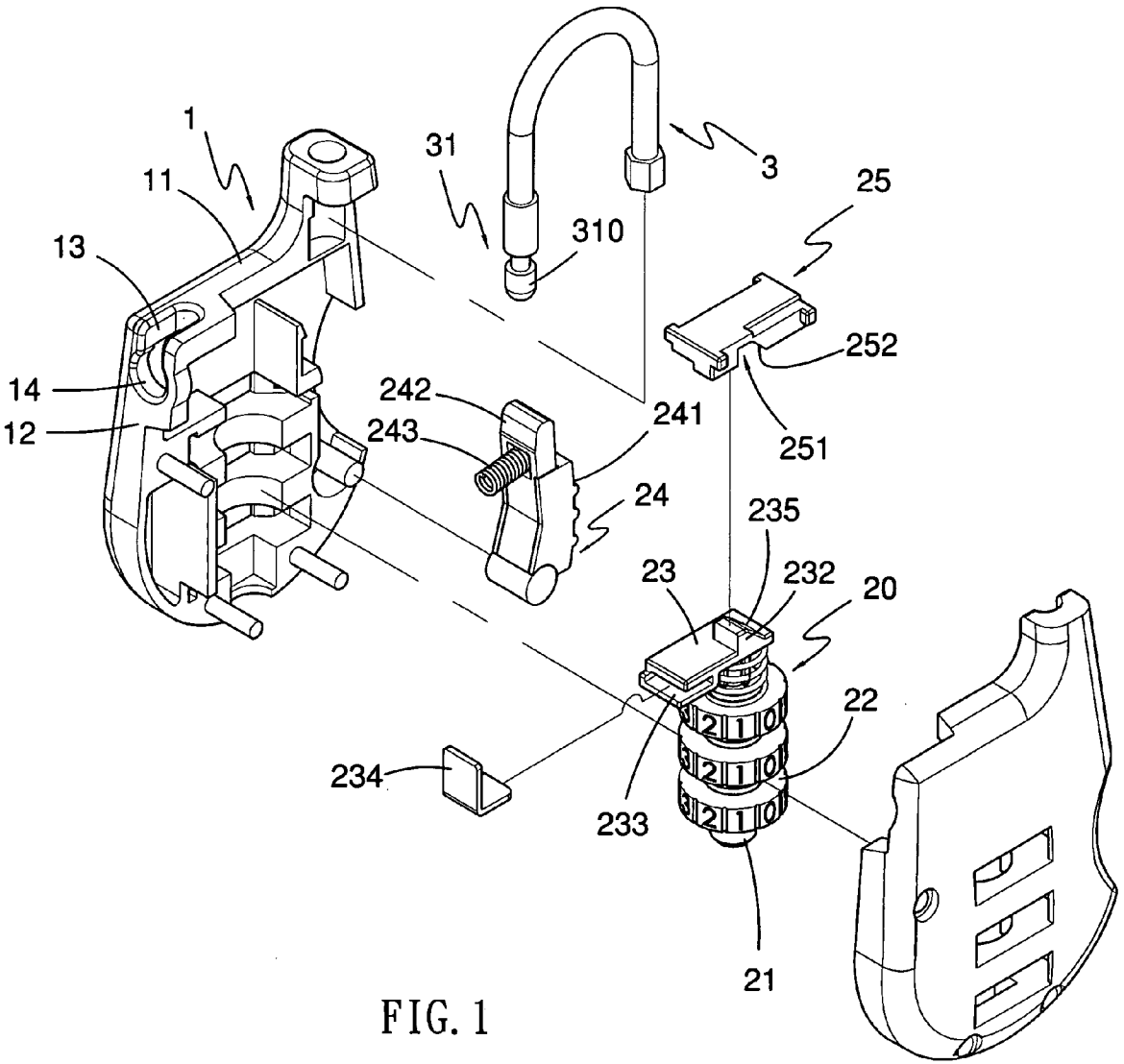
FIG. 1 is an exploded view to show the cable lock of the present invention.
Figure 2:
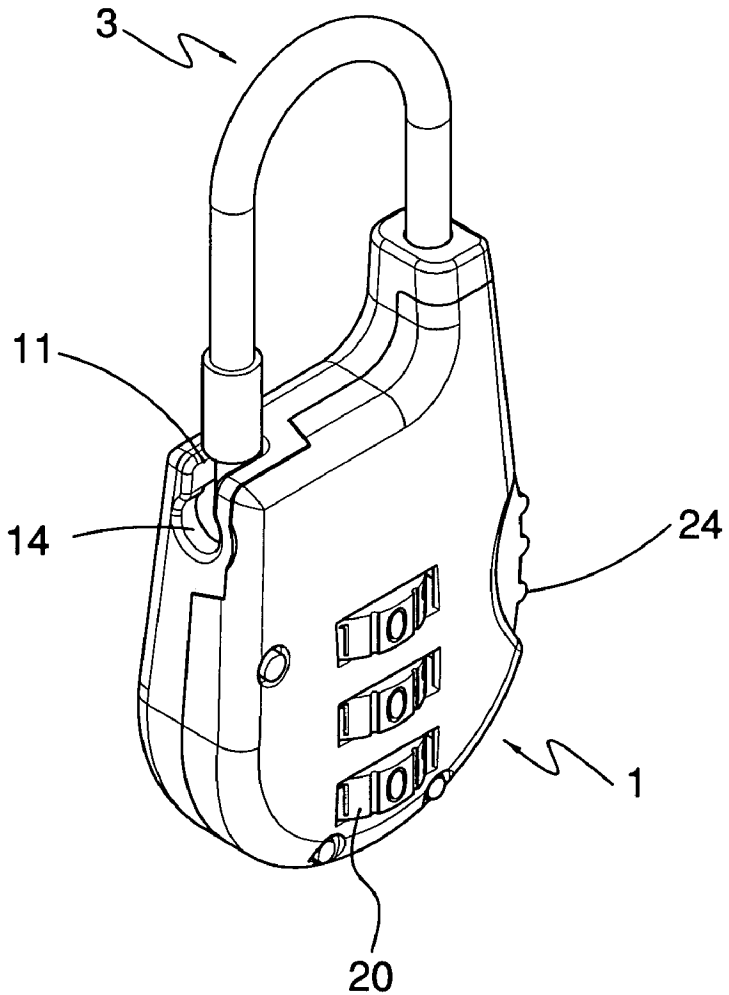
FIG. 2 is a perspective view to show the cable lock of the present invention.
Figure 3:
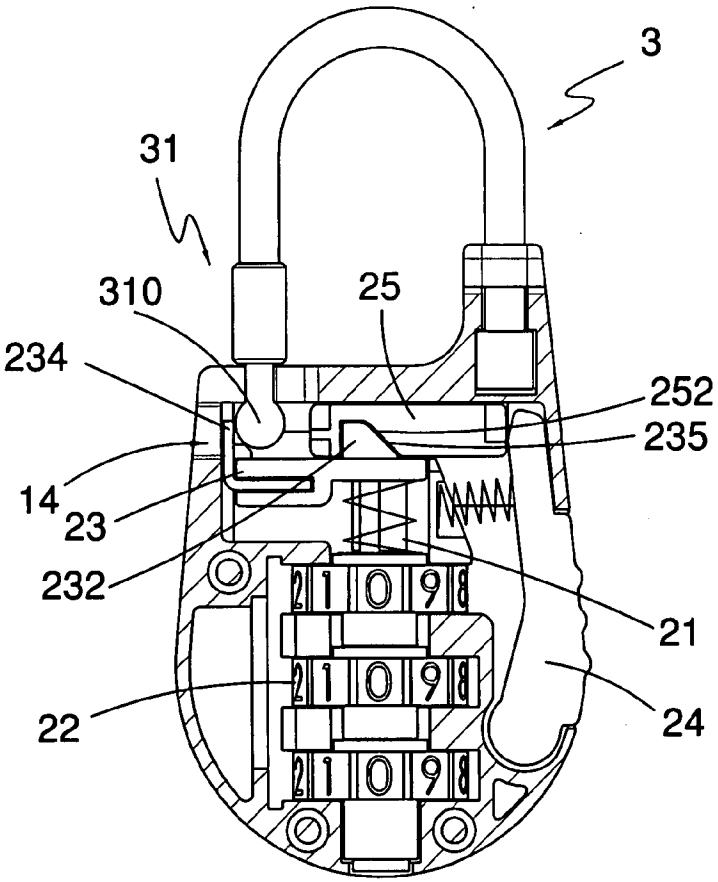
FIG. 3 is a cross sectional view to show the cable lock in locked status.

Referring to FIGS. 1 to 3, the cable lock of the present invention comprises a case 1 having a first side 11 and a second side 12 which is connected to the first side 11 and located at different plane from the first side 11. A slot 13 is defined through the first side 11 and the second side 12, and an opening 14 is defined through the second side 12 and in communication with the slot 13. A flexible cable 3 has one end fixed to the case 1 and a free end 31 of the flexible cable 3 is removably engaged with the opening 14 and the slot 13. The free end 31 has an enlarged head 310 which is larger than the slot 13 and allows to pass in and pass out from the opening 14. A groove defined in the free end 31 and the periphery of the slot 13 can be engaged with the groove to limit the enlarged head 310 from disengaging from the slot 13 when in locked status.

A lock device includes a combination unit 20 received in the case 1 and has dial rings 22 which are accessible from an outside of the case 1. The combination unit 20 includes a shaft 21 which may movably extend through the combination unit 20 if the correct dials are input by operating the dial rings 22. A top plate 23 is connected to a top of the shaft 21 and includes a protrusion 232 extending from a top thereof. The protrusion 232 has a first inclined surface 235. A slit 233 is defined in an end of the top plate 23 and a stop plate 234 is an L-shaped plate which has one distal end inserted in the slit 233. The stop plate 234 is located inside of the second side 12 and movably blocks the opening 14 in locked status. An action plate 25 has a recess 251 defined in an underside thereof and the recess 251 is defined by a second inclined surface 252 which matches with the first inclined surface 235. An end of the action plate 25 is pushed by a pushing end 242 of a button 24 which is pivotably connected to the case 1. The pushing end 242 of the button 24 drives the action plate 25 when pressing the pressing surface 241 of the button 24 and the action plate 25 pushes the top plate 23 and the shaft 21 downward so as to remove the stop plate 234 away from the opening 14. A spring 243 is connected to the pushing end 242 of the button 24 so that the button 24 pivots back after the user releases the button 24.

Figure 4:
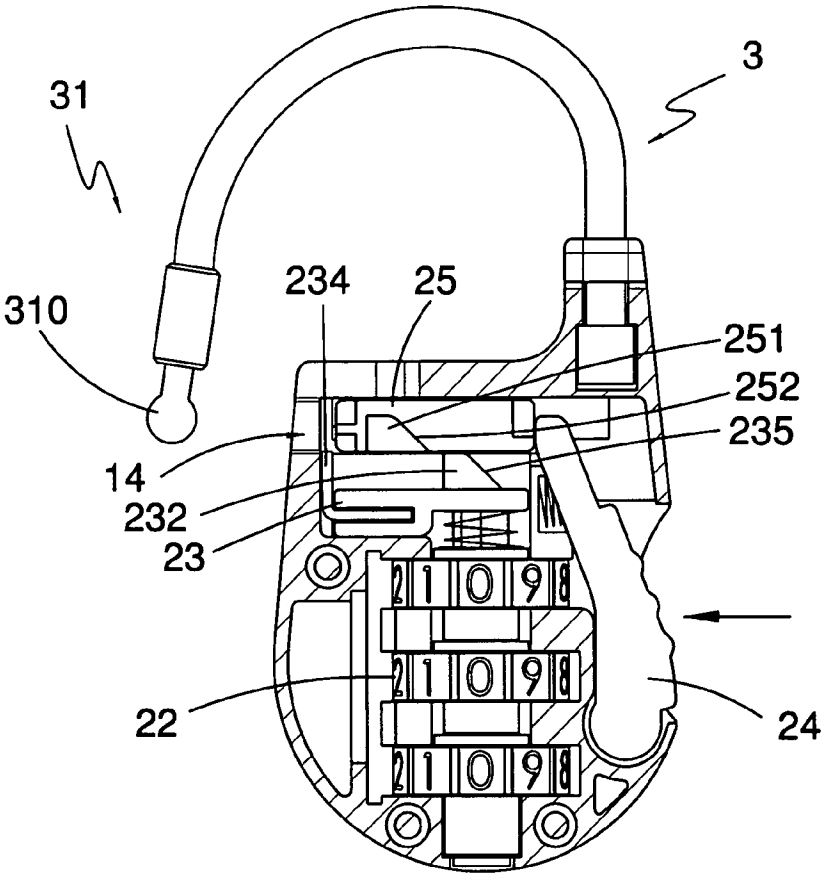
FIG. 4 is a cross sectional view to show that the cable lock is unlocked by pushing the button.

Referring to FIG. 4, when unlocking the lock, the correct combination of dials is input via the dial rings 22 and the button 24 is pressed, the second inclined surface 252 pushes the first inclined surface 235 to move the top plate 23 and the shaft 21 downward, the L-shaped stop plate 234 is then removed from the opening 14 and the free end 31 of the flexible cable 3 is disengaged from the opening 14. It is noted that, the user can unlock the lock by only one hand.

Figure 5:
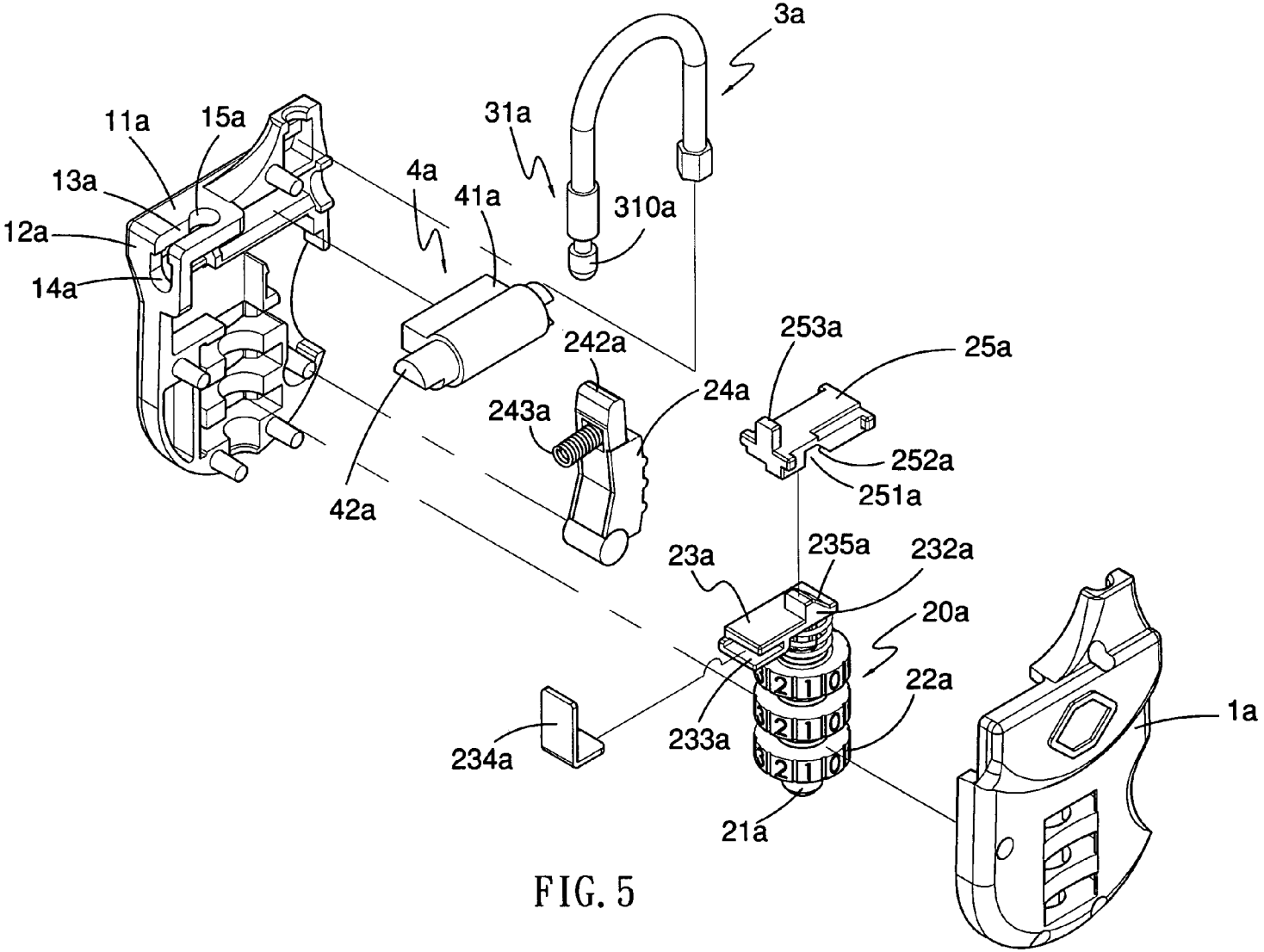
FIG. 5 is an exploded view to show another embodiment of the cable lock of the present invention.
Figure 6:
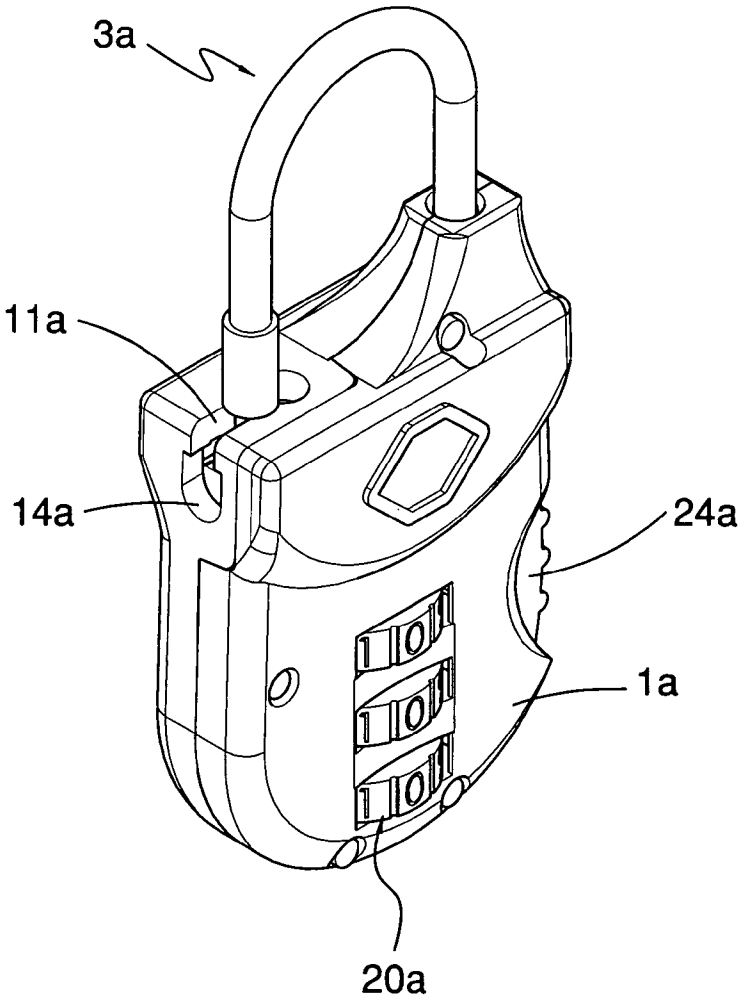
FIG. 6 is a perspective view to show the cable lock in FIG. 5 of the present invention.
Figure 7:
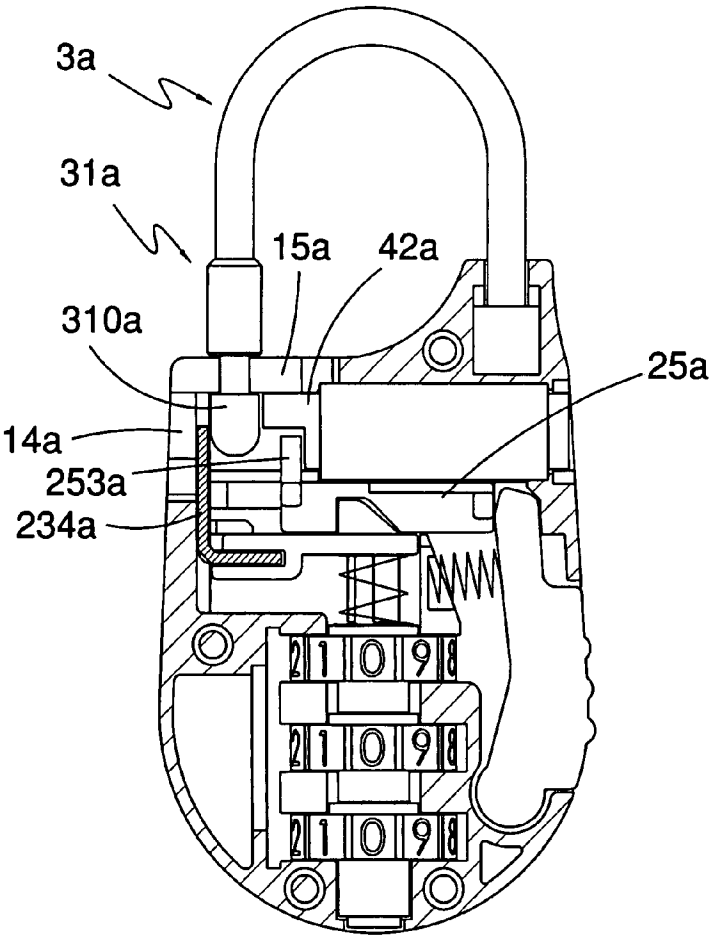
FIG. 7 is a cross sectional view to show the cable lock in FIG. 5 in locked status.

Referring to FIGS. 5 to 7, another embodiment of the cable lock of the present invention is similar to the cable lock in FIG. 1 and generally includes a case 1*a* having a first side 12*a* and a second side 11*a* which is connected to the first side 12*a*. A slot 13*a* is defined through the first side 12*a* and the second side 11*a*. A first opening 14*a* is defined through the first side 12*a* and a second opening 15*a* is defined through the second side 11*a*. The first opening 14*a* and the second opening 15*a* are in communication with the slot 13*a* and located at two ends of the slot 13*a*. A flexible cable 3*a* has one end fixed to the case 1*a* and a free end 31*a* of the flexible cable 3*a* is removably engaged with the first opening 14*a* and second opening 15*a* and the slot 13*a*. The free end 31*a* of the flexible cable 3*a* including an enlarged head 310*a* which is larger than the slot 13*a* and allows to pass in and pass out from the first opening 14*a* and the second opening 15*a*.

A first lock device includes a combination unit 20*a* received in the case 1*a* and has dial rings 22 which are accessible from an outside of the case 1. The combination unit 20*a* includes a shaft 21*a* which may movably extend through the combination unit 20*a* if correct combination of dials is input via the dial rings 22*a*. A top plate 23*a* is connected to a top of the shaft 21*a* and includes a protrusion 232*a* extending from a top thereof. The protrusion 232*a* has a first inclined surface 235*a*. A slit 233*a* is defined in an end of the top plate 23*a* and a stop plate 234*a* is an L-shaped plate which has one distal end inserted in the slit 233*a*. The stop plate 234*a* is located inside of the first side 12*a* and movably blocks the first opening 14*a* in locked status.

An action plate 25*a* has a recess 251*a* defined in an underside thereof and the recess 251*a* is defined by a second inclined surface 252*a* which matches with the first inclined surface 235*a*. An end of the action plate 25*a* is pushed by a pushing end 242*a* of a button 24*a* which is pivotably connected to the case 1*a*. The action plate 25*a* includes an extension portion 253*a* extending from a top thereof and the extension portion 253*a* may push the free end 31*a* of the flexible cable 3*a* out from the first opening 14*a*.

Figure 8:
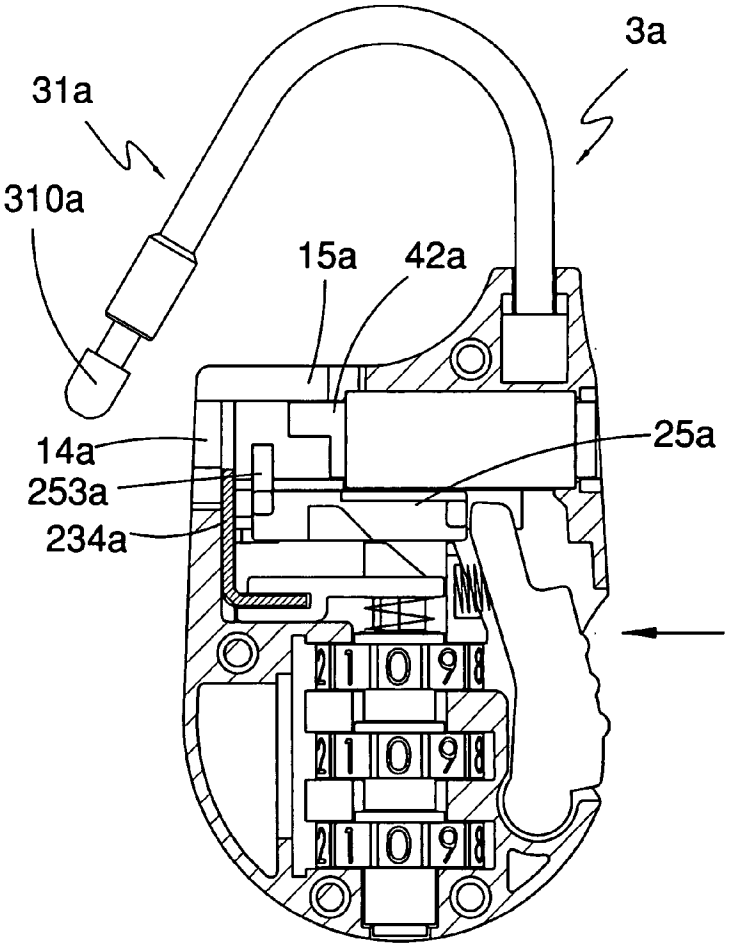
FIG. 8 is a cross sectional view to show that the cable lock is unlocked by pushing the button and the free end of the flexible cable is disengaged from the first opening.

As shown in FIG. 8, when unlocking the lock, after the correct combination of dials is input, the button 24*a* is pressed and the second inclined surface 252*a* pushes the first inclined surface 235*a* to move the top plate 23*a* and the shaft 21*a* downward. The L-shaped stop plate 234*a* is then removed from the first opening 14*a* and the free end 31*a* of the flexible cable 3*a* is disengaged from the first opening 14*a*. In the meanwhile, the extension portion 253*a* pushes the free end 31*a* of the flexible cable 3*a* out from the first opening 14*a*. After the user release the button 24*a*, the spring 243*a* connected to the pushing end 242*a* of the button 24*a* pivots the button 24*a* back to its original position.

Figure 10:
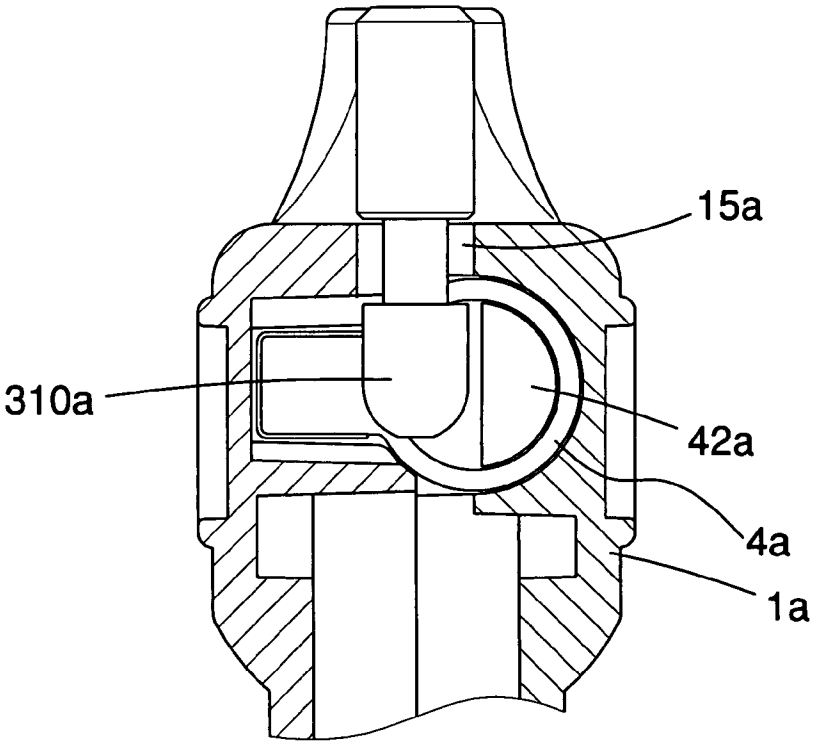
FIG. 10 shows the free end of the flexible cable is not stopped by the tongue of the second lock device.
Figure 9:
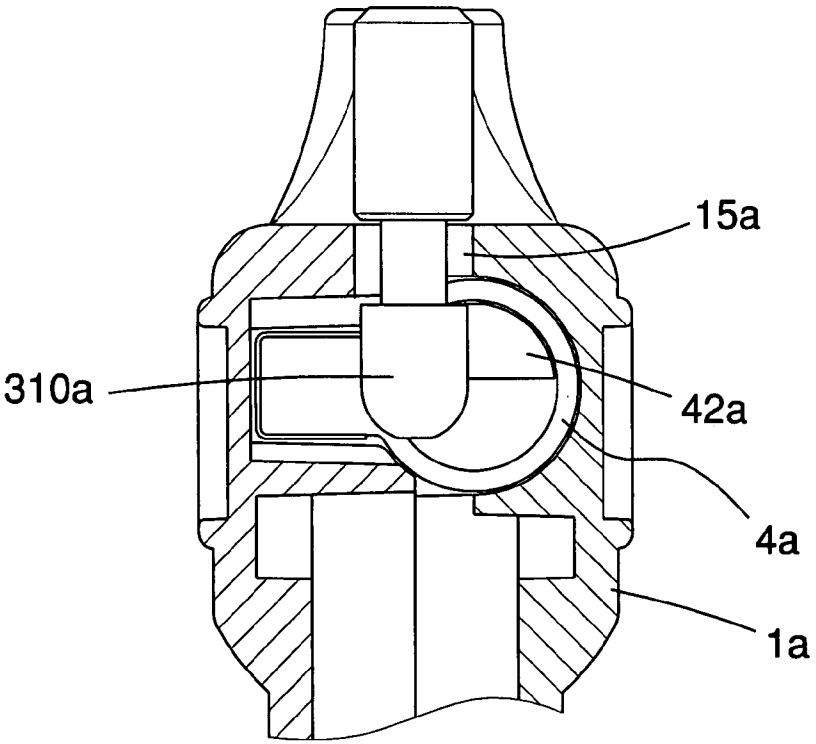
FIG. 9 shows the free end of the flexible cable is stopped by the tongue of the second lock device.
Figure 11:
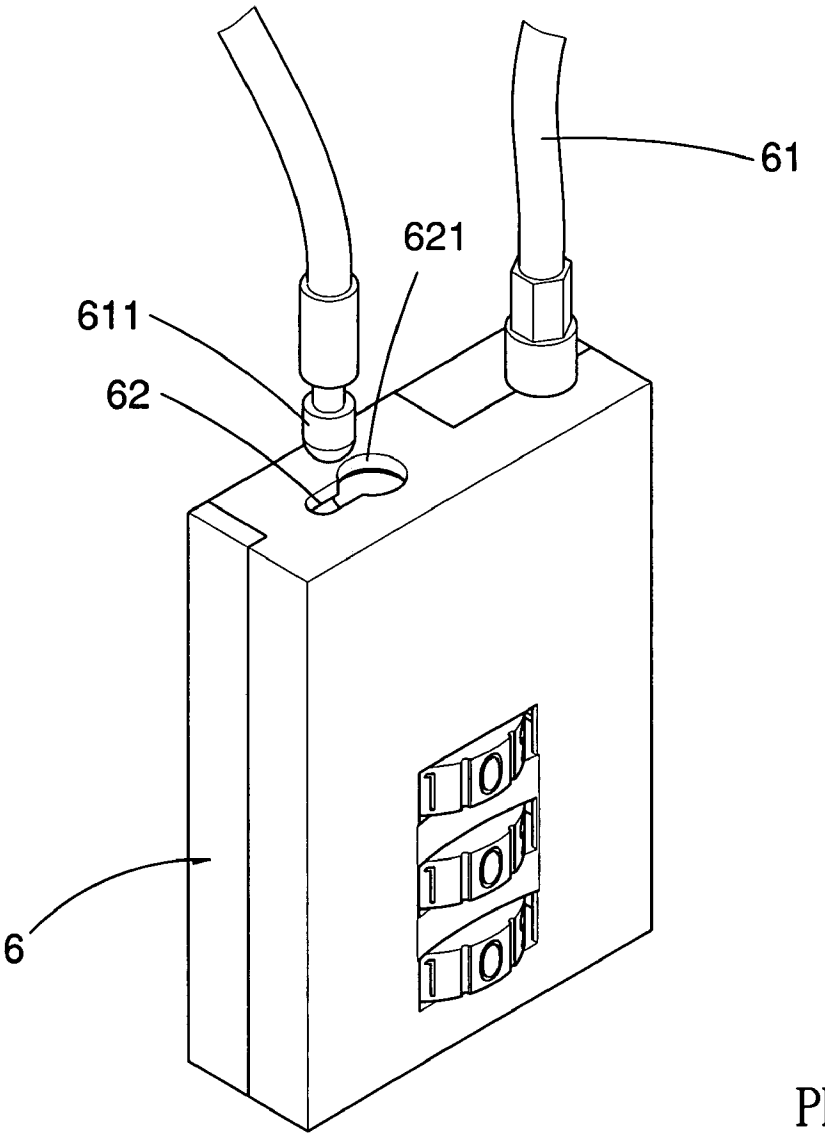
FIG. 11 PRIOR ART
FIG. 11 shows a conventional lock with a flexible cable.

Referring to FIGS. 9 and 10, this embodiment further comprises a second lock device 4*a* received in the case 1*a* and includes lock core 41*a* and a tongue 42*a* which is rotatably connected to the lock core 41*a*. The tongue 42*a* is rotatable between a lock position which blocks the second opening 15*a*, and an unlock position which the free end 31*a* of the flexible cable 3*a* is able to be removed from the second opening 15*a*. The lock core 41*a* is operated by using a key which is not shown. The tongue 42*a* is an elongate piece having a semi-circular cross section so that when the lock core 41*a* is in a locked status as shown in FIG. 9, the free end 31*a* of the flexible cable 3*a* cannot be moved in the slot 13*a* and removed from the second opening 15*a*. When the tongue 42*a* is rotated an angle as shown in FIG. 10, the free end 31*a* of the flexible cable 3*a* can be moved in the slot 13*a* and removed from the second opening 15*a*.

While we have shown and described the embodiment in accordance with the present invention, it should be clear to those skilled in the art that further embodiments may be made without departing from the scope of the present invention.

The invention claimed is:

1. A cable lock comprising:

a case having a first side and a second side which is connected to the first side, a slot defined through the first side and the second side, an opening defined through the second side and being in communication with the slot;

a lock device received in the case and controlling the opening; and a flexible cable having one end fixed to the case and a free end of the flexible cable removably engaged with the opening and the slot, the free end including an enlarged head which is larger than the slot and allows to pass in and pass out from the opening, wherein the lock device includes a combination unit having dial rings which are accessible from an outside of the case, the combination unit including a shaft which movably extends through the combination unit, a top plate connected to a top of the shaft and having a stop plate which is located inside of the second side and movably blocking the opening, a button pivotably connected to the case and capable of pushing an action plate which pushes the top plate to remove the stop plate away from the opening.

2. The cable lock as claimed in claim 1, wherein the button includes a pressing surface, a pushing end and a spring connected to the pushing end of the button, the pushing end being capable of pushing the action plate.

3. The cable lock as claimed in claim 2, wherein the top plate includes a protrusion extending from a top thereof and the protrusion has a first inclined surface, the action plate having a recess defined in an underside thereof, the recess defined by a second inclined surface which matches with the first inclined surface, an end of the action plate is pushed by the pushing end of the button.

4. The cable lock as claimed in claim 3, wherein a slit is defined in an end of the top plate and the stop plate is an L-shaped plate which has one distal end inserted in the slit.

5. A cable lock comprising:

a case having a first side and a second side which is connected to the first side, a slot defined through the first side and the second side, a first opening defined through the first side and a second opening defined through the second side, the first opening and the second opening being in communication with the slot;

a first lock device received in the case and controlling the first opening;

a second lock device received in the case and controlling the second opening, and a flexible cable having one end fixed to the case and a free end of the flexible cable removably engaged with the first opening, the second opening and the slot, the free end of the flexible cable including an enlarged head which is larger than the slot and allows to pass in and pass out from the first opening and the second opening.

6. The cable lock as claimed in claim 5, wherein the first lock device includes a combination unit having dial rings which are accessible from an outside of the case, the combination unit including a shaft which movably extends through the combination unit, a top plate connected to a top of the shaft and having a stop plate which is located inside of the first side and movably blocking the first opening, a button pivotably connected to the case and capable of pushing an action plate which pushes the top plate to remove the stop plate away from the first opening, the second lock device received in the case and including a lock core and a tongue which is rotatably connected to the lock core, the tongue being rotatable between a lock position which blocks the second opening, and an unlock position which the free end of the flexible cable is removed from the second opening.

7. The cable lock as claimed in claim 6, wherein the tongue is an elongate piece having a semi-circular cross section.

8. The cable lock as claimed in claim 6, wherein the button includes a pressing surface, a pushing end and a spring connected to the pushing end of the button, the pushing end being capable of pushing the action plate.

9. The cable lock as claimed in claim 8, wherein the top plate includes a protrusion extending from a top thereof and the protrusion has a first inclined surface, the action plate having a recess defined in an underside thereof, the recess defined by a second inclined surface which matches with the first inclined surface, an end of the action plate is pushed by the pushing end of the button.

10. The cable lock as claimed in claim 6, wherein the action plate includes an extension portion extending from a top thereof and the extension portion pushes the free end of the flexible cable out from the first opening.

11. The cable lock as claimed in claim 9, wherein a slit is defined in an end of the top plate and the stop plate is an L-shaped plate which has one distal end inserted in the slit.

* * * * *